US009967666B2

(12) United States Patent
Fersch et al.

(10) Patent No.: US 9,967,666 B2
(45) Date of Patent: May 8, 2018

(54) RENDERING OF AUDIO CONTENT

(71) Applicants: Dolby International AB, Amsterdam Zuidoost (NL); Dolby Laboratories Licensing Corporation, San Francisco, CA (US)

(72) Inventors: Christof Fersch, Bavaria (DE); Freddie Sanchez, Berkeley, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 22 days.

(21) Appl. No.: 15/094,407

(22) Filed: Apr. 8, 2016

(65) Prior Publication Data

US 2016/0300577 A1 Oct. 13, 2016

Related U.S. Application Data

(60) Provisional application No. 62/148,581, filed on Apr. 16, 2015.

(30) Foreign Application Priority Data

Apr. 8, 2015 (CN) ..... 2015 1 0164152

(51) Int. Cl.
*H04R 5/00* (2006.01)
*H04R 3/12* (2006.01)

(52) U.S. Cl.
CPC ..... *H04R 3/12* (2013.01)

(58) Field of Classification Search
CPC ..... H04R 3/12; G10L 19/008
USPC ..... 381/17, 22, 23, 119
See application file for complete search history.

(56) References Cited

U.S. PATENT DOCUMENTS

| | | | | |
|---|---|---|---|---|
| 8,321,564 | B2 | 11/2012 | Palm | |
| 8,718,285 | B2 | 5/2014 | Ishikawa | |
| 2011/0040395 | A1* | 2/2011 | Kraemer | G10L 19/00 700/94 |
| 2012/0230497 | A1 | 9/2012 | Dressler | |

(Continued)

FOREIGN PATENT DOCUMENTS

| | | |
|---|---|---|
| WO | 2012/125855 | 9/2012 |
| WO | 2013/192111 | 12/2013 |

(Continued)

OTHER PUBLICATIONS

Chan, K.K.P, et al "Distributed Sound Rendering for Interactive Virtual Environments" IEEE International Conference on Multimedia and Expo, vol. 3, Jun. 27-30, 2004, pp. 1823-1826.

*Primary Examiner* — Katherine Faley
(74) *Attorney, Agent, or Firm* — Charles L. Hamilton; Fountainhead Law Group, P.C.

(57) ABSTRACT

Example embodiments disclosed herein relate to audio content rendering. A method of rendering audio content is disclosed, which includes determining a priority level for an audio object in the audio content, selecting a rendering mode from a plurality of rendering modes for the audio object based on the determined priority level and rendering the audio object in accordance with the selected rendering mode, the rendering mode indicating an accuracy of the rendered audio object. Corresponding system and computer program product are also disclosed.

17 Claims, 3 Drawing Sheets

(56) References Cited

U.S. PATENT DOCUMENTS

| | | | | |
|---|---|---|---|---|
| 2012/0288012 | A1* | 11/2012 | Staikos | G06F 9/5038 375/240.25 |
| 2013/0129098 | A1 | 5/2013 | Gjerde | |
| 2013/0202129 | A1 | 8/2013 | Kraemer | |
| 2013/0236032 | A1 | 9/2013 | Wakeland | |
| 2013/0329922 | A1 | 12/2013 | Lemieux | |
| 2014/0023337 | A1 | 1/2014 | Jain | |

FOREIGN PATENT DOCUMENTS

| | | |
|---|---|---|
| WO | 2014/035902 | 3/2014 |
| WO | 2014/035903 | 3/2014 |
| WO | 2014/036121 | 3/2014 |
| WO | 2014/122550 | 8/2014 |

* cited by examiner

RENDERING OF AUDIO CONTENT

CROSS-REFERENCE TO RELATED APPLICATIONS

The present application claims the benefit of priority from U.S. provisional patent application No. 62/148,581, filed Apr. 16, 2015, and Chinese application number 201510164152.X, filed Apr. 8, 2015, each of which is incorporated herein by reference in its entirety.

TECHNOLOGY

Example embodiments disclosed herein generally relate to audio content processing, and more specifically, to a method and system for rendering audio content.

BACKGROUND

Traditionally, audio content of multi-channel format (e.g., stereo, 5.1, 7.1, and the like) or of mono format with metadata is created by mixing different audio signals in a studio, or generated by recording acoustic signals simultaneously in a real environment. The mixed audio signal or content may include a number of different audio objects. Ideally, all of the objects need to be rendered in order to perform a vivid and immersive representation of the audio content over time. The information regarding the audio object can be in the form of metadata, and the metadata may include the position, size (which may include width, depth and height), divergence, etc. of a particular audio object. The more information that is provided, the more accurately the audio objects can be rendered.

If an audio object is to be rendered, some computational resources will be needed. However, when a number of audio objects are included in the audio content, it usually requires a considerable amount of computational resources to correctly render all of the audio objects, namely, to render each and every object with accurate position, size, divergence, and the like. The total computational resources available to render audio content may vary for different systems, and unfortunately the available computational resources provided by some less powerful systems are usually insufficient to render all of the audio objects.

In order to render the audio content successfully by systems with limited computational resources, one existing way is to preset a priority level for each of the audio objects. The priority level is usually preset by the mixer when the audio objects are created or by the system when the audio objects are automatically separated. The priority level represents how important it is to render the particular object in an ideal way, taking all of its metadata into consideration, compared to the other objects. When the total available computational resources are not sufficient to render all of the audio objects, the audio objects with lower priority levels may be discarded in order to save computational resources for those with higher priority levels. By this process, audio objects with higher importance may be rendered while some less important objects may be discarded, so that the audio objects can be selectively rendered with limited supply of computational resources and thus the audio content can be rendered.

However, in some particular time frames when many objects need to be rendered simultaneously, there may be a lot of audio objects discarded, resulting in a low fidelity of the audio reproduction.

In view of the foregoing, there is a need in the art for a solution for allocating the computational resources more reasonably and rendering the audio content more efficiently.

SUMMARY

In order to address the foregoing and other potential problems, example embodiments disclosed herein proposes a method and system for rendering audio content.

In one aspect, example embodiments disclosed herein provide a method of rendering audio content. The method includes determining a priority level for an audio object in the audio content selecting a rendering mode from a plurality of rendering modes for the audio object based on the determined priority level and rendering the audio object in accordance with the selected rendering mode, the rendering mode indicating an accuracy of the rendered audio object. Embodiments in this regard further include a corresponding computer program product.

In another aspect, example embodiments disclosed herein provide a system for rendering audio content. The system includes a priority level determining unit configured to determine a priority level for an audio object in the audio content; a rendering mode selecting unit configured to select a rendering mode from a plurality of rendering modes for the audio object based on the determined priority level and an audio object rendering unit configured to render the audio object in accordance with the selected rendering mode, the rendering mode indicating an accuracy of the rendered audio object.

Through the following description, it would be appreciated that in accordance with example embodiments disclosed herein, different rendering modes are assigned to audio objects according to their priority levels, so that the objects can be treated differently. Therefore, all of (or at least almost all of) the objects are able to be rendered even the available total computational resources are limited. Other advantages achieved by the example embodiments disclosed herein will become apparent through the following descriptions.

DESCRIPTION OF DRAWINGS

Through the following detailed descriptions with reference to the accompanying drawings, the above and other objectives, features and advantages of the example embodiments disclosed herein will become more comprehensible. In the drawings, several example embodiments disclosed herein will be illustrated in an example and in a non-limiting manner, wherein.

Throughout the drawings, the same or corresponding reference symbols refer to the same or corresponding parts.

DESCRIPTION OF EXAMPLE EMBODIMENTS

Figure 1:
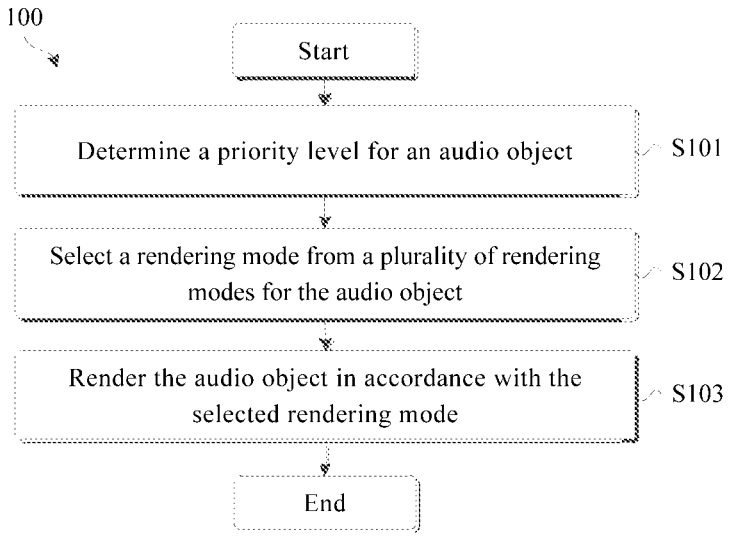
FIG. 1 illustrates a flowchart of a method for rendering audio content in accordance with an example embodiment.

Principles of the example embodiments disclosed herein will now be described with reference to various example embodiments illustrated in the drawings. It should be appreciated that the depiction of these embodiments is only to enable those skilled in the art to better understand and further implement the example embodiments disclosed herein, not intended for limiting the scope in any manner.

The example embodiments disclosed herein assumes that the audio content as input is already processed to include separated audio objects. In other words, the method according to the example embodiments disclosed herein aims to process either a single audio object or a plurality of separated audio objects. Different from conventional ways to render audio objects with limited computational resources, which may discard a number of audio objects for some time frames, the example embodiments disclosed herein intends to provide a rendering for all of (or at least almost all of) the audio objects at any time. The audio objects will be rendered in different rendering modes according to their priority level, so that less important objects may be rendered in a less complex way to save computational resources, while important objects may be rendered without compromise by allocating more computational resources.

In order to achieve the above purpose, example embodiments disclosed herein proposes a method and system for rendering audio content. Embodiments will be given in the following.

Reference is first made to FIG. 1 which shows a flowchart of a method 100 for rendering audio content in accordance with example embodiments of the present invention.

In one example embodiment disclosed herein, at step S101, a priority level for an audio object in the audio content is determined. It should be noted that a priority level may be provided for each of the audio objects as preset by the mixer in one case. However, in some other cases, only some of the audio objects may contain their corresponding priority levels while the rest objects are free of such information. The determining step S101 aims to obtain a priority level for each audio object or assign a priority level to the audio object without a preset priority metadata according to a certain rule. After the step S101, the audio content may include one or a number of audio objects, each containing a corresponding priority level.

The priority level according to the example embodiments disclosed herein may be represented in various forms. By way of example only, the priority level may be represented by a number from 1 to N. In this particular example, the total number of audio objects can be N and each of the audio objects can be assigned with one of the priority levels from 1 to N, where 1 possibly represents the highest priority while N represents the lowest priority, or vice versa. The priority level according to the example embodiments disclosed herein can be used to indicate the sequence to render the audio objects. It is to be understood that any appropriate form can be used to represent the priority level once a certain rule is preset, so that the priority levels can be recognized at the step S101.

In one example embodiment disclosed herein, for each of the audio objects in the audio content, if the audio object includes priority metadata as preset by the mixer for example, the priority metadata may be extracted for setting the priority level for the audio object in a proper form as described above. However, if the audio object includes no priority metadata, a predefined level may be assigned to be the priority level according to a certain rule. This rule may be based on spectral analysis. For example, if a particular audio object is determined to be human voice with a relatively high sound level, it may be assigned with the highest priority level, because it is highly possible to be a voice for an important narrator or character. On the other hand, if a particular audio object has its position far from the center of the entire sound field and has a relatively low sound level, it may be assigned with lower priority level. Other metadata of the audio object such as the object's gain may also be useful when determining how important the object is.

At step S102, a rendering mode is selected from a plurality of rendering modes for the audio object on the basis of the determined priority level. In one example embodiment disclosed herein, the rendering mode representing how accurate the audio object is eventually rendered. Some of the rendering modes may include: mixing the object at only one output channel, mixing the object equally at all output channels, rendering the object having a corrected position, rendering the object having a corrected position, size and divergence, and the like.

As shown in Table 1 below, some example rendering modes and their corresponding descriptions are provided. Each of the rendering modes may correspond to a computational complexity, which represents how demanding a rendering mode is in terms of computational resources.

TABLE 1

| Rendering mode | Rendering description | Computational complexity |
|---|---|---|
| A | Fully render the audio object to present each and every of its parameters (such as position, size, divergence, etc.) | Most complex |
| B | Render the audio object to the correct position, but not render other parameters | Less complex |
| C | Perform a panning of the audio object through a given array of output channels over time | from B to E |
| D | Mix the audio object into two or more output channels equally | |
| E | Mix the audio object at only one output channel | |
| F | Discard (or mute) the audio object | Least complex |

In this embodiment, six rendering modes from A to F are provided, each corresponding to a computational complexity. For rendering mode A, the audio object may be fully rendered, meaning that each of every of parameters of the audio object will be presented and the audio object is rendered with the highest accuracy. Audiences may perceive the fully rendered audio object with accurate, immersive, vivid and thus enjoyable reproduction. Ideally, all of the audio objects are to be rendered in the rendering mode A for bringing the best performance. However, this rendering mode A is the most complex mode, and thus requires the most computational resources. As a result, there are usually insufficient computational resources available to render all of the audio objects in this mode.

As for the rendering mode B, it may render the audio object to its correct and accurate position, but ignore the processing of other parameters, such as size, divergence, and the like. In this regard, the audio object rendered in this mode requires less computational resources compared with the one rendered in the rendering mode A.

The rendering mode C pans the audio object through a given array of output channels over time. This means that the audio object will be placed correctly along one axis, e.g., along the horizontal axis, while the positioning along other axes may be ignored. Therefore, this mode may only utilize some of the channels (e.g., for a left speaker, a center speaker and a right speaker all of which placed in front of the audience) to reproduce the audio object, and thus requires less computational resources compared with the rendering mode B, which may utilize all of the output channels to reproduce the audio object.

For the rendering mode D, the system simply mixes the audio object equally into two or more output channels, depending on the number of output channels. In this mode, although the position of the audio object may not be correctly rendered, it requires much less computational resources compared with the previous modes. For the rendering mode E, the audio object will only be mixed into one output channel, which is the worst performed situation, but the audio object is still audible. Finally for the rendering mode F, the audio object may not be rendered, meaning that the audio object is discarded or muted.

It is to be understood that the six example rendering modes as illustrated in Table 1 are only used to describe several possible rendering modes. There may be more or less rendering modes provided. For example, there can be an additional rendering mode between the modes A and B for rendering the audio object with correct position and size.

In one example embodiment disclosed herein, the audio objects with different priority levels may be assigned with different rendering modes. For example, the rendering mode A will be selected for the audio object with the highest priority level, and the rendering modes B through E will be selected for audio objects with lower priority levels accordingly. If all of the audio objects can be assigned with a rendering mode, there will be no audio object assigned with the rendering mode F (being discarded or muted).

At step S103, the audio object is rendered in accordance with the selected rendering mode, and thus most or all of the audio objects will be rendered with minimum computational resources wasted.

As described above, in one embodiment, N audio objects may be assigned with N priority levels. As shown in Table 2 below, several computing levels may correspond to the plurality of rendering modes, and one of the computing levels may be assigned to the audio object based on its priority level.

TABLE 2

| Rendering mode | Computing level | Computational resources required (MHz) |
|---|---|---|
| A | $C_1$ | 70 |
| B | $C_2$ | 20 |
| C | $C_3$ | 8 |
| D | $C_4$ | 4 |
| E | $C_5$ | 2 |
| F | $C_6$ | 0 |

In this embodiment, the rendering modes A to F may have corresponding meanings as explained above with regard to Table 1, and each of the computing levels $C_1$ to $C_6$ may require an amount of computational resources to render the audio object with the corresponding rendering mode. For example, there are 10 audio objects, and their priority levels are 1 to 10 (with 1 indicating the highest priority). For the top two prioritized audio objects, they may be assigned with the computing level $C_1$ and thus will have the rendering mode A. Accordingly, audio objects with priority levels 3 through 10 will be respectively assigned with the computing levels $C_2$, $C_2$, $C_3$, $C_3$, $C_4$, $C_4$, $C_5$ and $C_5$, and thus will have the rendering modes B, B, C, C, D, D, E and E, correspondingly. By way of example only, the computing levels C1 to C6 correspondingly require computational resources 70, 20, 8, 4, 2, and 0 MHz. Therefore, the total consumed computational resources will be $70\times2+20\times2+8\times2+4\times2+2\times2=208$ MHz.

It is to be understood that N audio objects can also have less than N priority levels. For example, in one embodiment, two top important audio objects may share the priority level of 1, and the next two audio objects may share the priority level of 2, and so forth. In other words, there can be alternative forms provided to represent the priority levels once the audio objects can be prioritized in sequence so as to assign one of the computing levels and thus the corresponding rendering mode to each of the audio objects in order.

In one another embodiment, the audio object(s) with the highest priority level may be clustered into a first group, while the rest audio object(s) may be clustered into a second group. The first group may be assigned with the top computing level such as $C_1$ as listed in Table 2, with each audio object contained in the first group rendered in the corresponding rendering mode A. The second group may then be assigned with a proper computing level in accordance with the available computational resources, the number of the audio objects, etc. In this particular embodiment, each audio object contained in the same second group may be rendered with a same rendering mode regardless of its priority level. It is to be understood that there can be additional group(s) provided, and each of the audio objects in different groups may be assigned with an appropriate rendering mode according to the priority level, available total computational resources for the audio content, and the quantity of the audio object.

In a further embodiment, all of the objects may be rendered more than once. For example, for the first time of rendering, each of the audio objects may be assigned with the lowest computing level so as to ensure all of the audio objects can be rendered anyway. Then, for the second time of rendering, each of the audio objects may be assigned with a computing level individually or independently in order to fully utilize the available computational resources. In other words, a predetermined rendering mode (e.g., the rendering mode E) may be first assigned to each of the audio objects, and then the rendering mode for each of the audio objects may be updated by selecting one proper rendering mode from a plurality of rendering modes.

Figure 2:
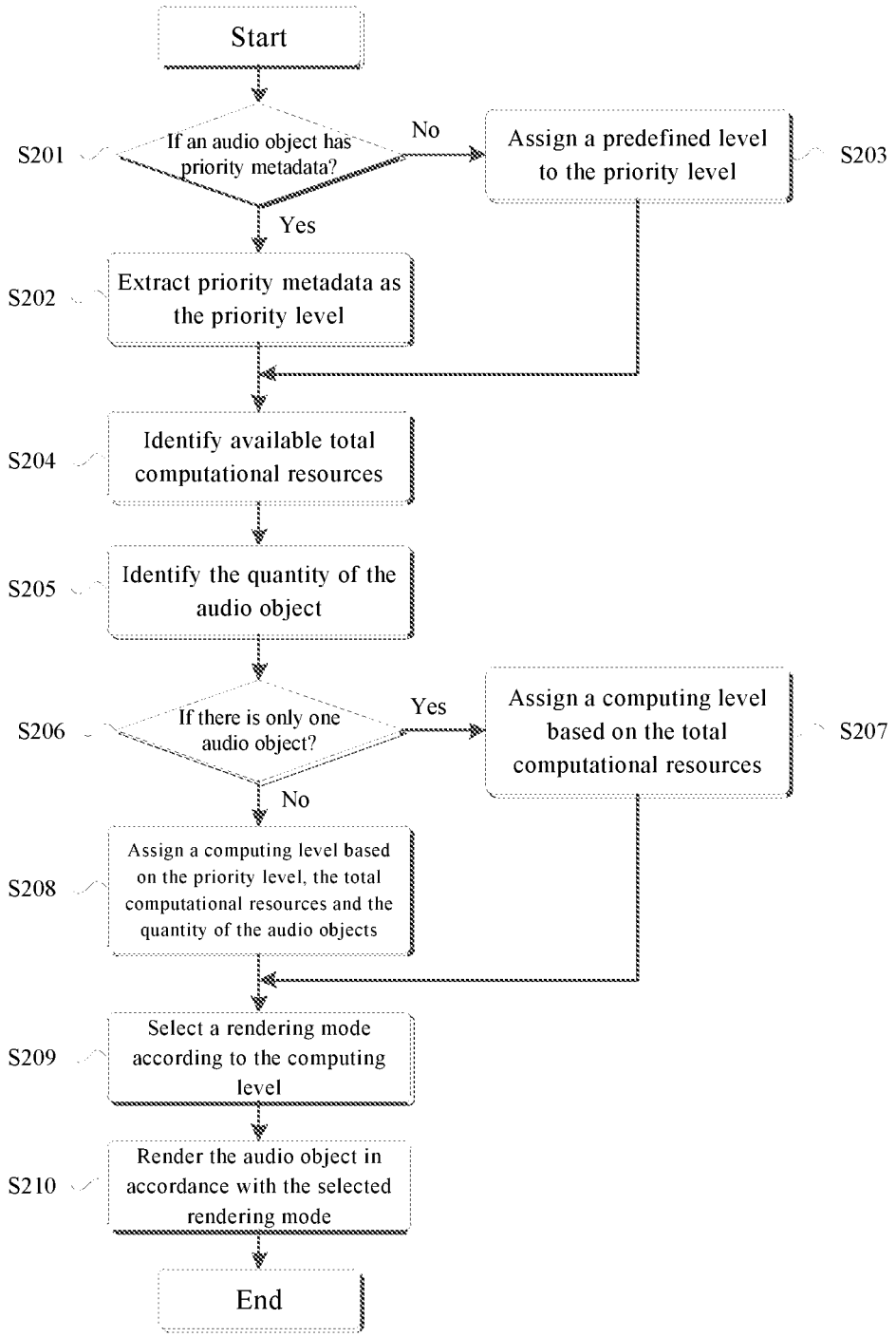
FIG. 2 illustrates a flowchart of a method for rendering audio content in accordance with another example embodiment.

FIG. 2 illustrates a flowchart of a method for rendering audio content in accordance with another example embodiment of the present invention.

At step S201, when the audio content containing separated audio objects is input, if the audio object includes priority metadata or priority information may need to be determined. If the audio object has priority metadata, the priority metadata may be extracted as the priority level for the audio object at step S202, and the priority level may be in the form of a number as described above or in any other form indicating the priority of the audio object. If the audio object has no priority metadata, a predefined level may be assigned to the priority level at step S203. Also, certain rules may be used to generate a priority level for the audio object without a priority metadata, such as the spectral analysis as described above.

Then, at step S204, available total computational resources may be identified. In one embodiment, the computational resources may be reflected by available processing power of the CPU, and each of the computing levels corresponds to an amount of computational resources, as indicated by Table 2. At step S205, the quantity of the audio object in the audio content to be rendered may also be identified.

Afterwards, if the quantity of the audio object is more than one may need to be determined at step S206. If there is only one audio object contained in the audio content to be rendered, the total computational resources available may need to be compared with different computing levels. Because each of the computing levels may consume a certain amount of computational resources (processing power), at step S207, a suitable computing level may be assigned to the only one audio object simply after the comparison. For example, if the available total computational resources are 100 MHz, by reference to Table 2, the computing level $C_1$ which consumes 70 MHz may be assigned in order to render the audio object for the best performance. In another case, if the available total computational resources are 50 MHz, the computing level $C_2$, which consumes 20 MHz, may be assigned.

At one time frame (simultaneously), if there are two or more audio objects in the audio content, the computing level may be assigned to each of the audio objects based on the priority level, the total computational resources and the number of the audio objects at step S208.

To achieve the above step, an algorithm or rule may be needed in order to assign the computing levels to the audio objects efficiently. An example rule is shown below for assigning one of the computing levels to each of the audio objects in sequence from the audio object with the highest priority level to the audio object with the lowest priority level. In this particular example, P represents the total computational resources left to be used, n represents the number of audio objects left to be assigned with computing levels, and $R_j$ represents computational resources required for a computing level with j-th priority level $C_j$.

For the audio object with highest priority level out of all the left (not yet rendered) audio objects:

if $P/n \geq R_1$, then assign $C_1$ to each of the audio objects; otherwise if $R_{j+1} \leq P/n < R_j$ and meanwhile $P \geq R_{j+1}+R_j$, then assign $C_j$ to this audio object; otherwise assign $C_{j+1}$ to this audio object.

The above rule may be applied to each of the audio objects in a sequence from the highest priority level to the lowest priority level. For example, if there are totally 4 audio objects that need to be assigned with computing levels and the total computational resources available for these 4 audio objects are 300 MHz (P=300), it can be calculated that P/n=75. According to Table 2, by way of example only, $R_1$ is 70 MHz which is smaller than 75. Therefore, each of the 4 audio objects may be assigned with $C_1$.

In another case, if there are totally 6 audio objects need to be assigned with computing levels and the total computational resources available for these 6 audio objects are 200 MHz (P=200), it can be calculated that P/n=33.3, which is smaller than 70 but larger than 20. Also, it is also true that $P \geq R_2+R_1$, and thus the audio object with the highest priority level may be assigned with $C_1$. Then, the total computational resources left will be 200−70=130 MHz (P=130), and n=5. It can be calculated that P/n=26 which is between 20 and 70, and P is also larger than the sum of 20 and 70. Therefore, this audio object with the second highest priority level may also be assigned with $C_1$.

After assigning two audio objects, there are 4 objects left to be assigned (n=4) and the usable computational resources are only 60 MHz, which makes P/n=15. As this value is between $R_2$ (20) and $R_3$ (8), and P is also larger than the sum of $R_2$ and $R_3$, this audio object with the third highest priority level may be assigned with $C_2$. Now P=40 and n=3, and P/n=13.3. As this value is between $R_2$ and $R_3$, and P is also larger than the sum of $R_2$ and $R_3$, this audio object with the fourth highest priority level may also be assigned with $C_2$.

For the first four audio objects, they are respectively assigned with computing levels of $C_1$, $C_1$, $C_2$ and $C_2$, and the total computational resources available for the last two audio objects is only 20 MHz, which makes P/n=10. Although this value is between $R_2$ (20) and $R_3$ (8), P is smaller than the sum of $R_2$ and $R_3$. As a result, according to the above rule, this audio object with the second lowest priority level may be assigned with $C_3$. For the last audio object with the lowest priority level, the available computational resources are only 12 MHz, which is between $R_2$ and $R_3$. However, 12 is smaller than the sum of $R_2$ and $R_3$, and thus this audio object with the lowest priority level may also be assigned with $C_3$.

In this example, the total consumed computational resources are 70+70+20+20+8+8=196 MHz, which takes up 98% of the total available computational resources. On the contrary, a conventional method normally renders the top two prioritized audio objects, while the rest audio objects are not rendered, meaning that 60 MHz or 30% of the total available computational resources are wasted. Therefore, the method of rendering audio content according to the example embodiments disclosed herein allows every audio object to be rendered (if the available computational resources are not too limited) and allows the computational resources to be allocated efficiently.

At step S209, a rendering mode may be selected for the audio object according to the assigned computing level. This step can be done by utilizing Table 2, in which one of the rendering modes corresponds to one computing level.

At step S210, the audio object may be rendered in accordance with the selected rendering mode, so that the audio content may be rendered over time.

It is to be understood that the example embodiments disclosed herein can be applied to audio content with different formats such as Dolby Digital, Dolby Digital Plus, Dolby E, Dolby AC-4, MPEG-H Audio, and the present invention does not intend to limit the format or form of the audio signal or audio content.

Figure 3:
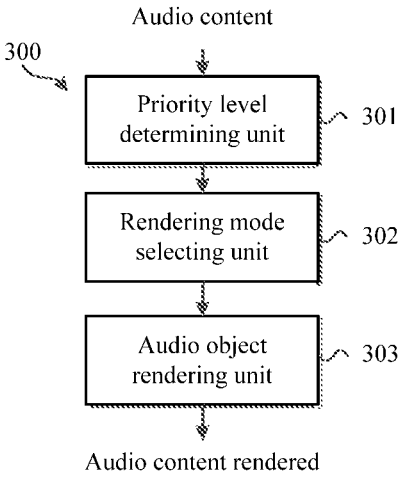
FIG. 3 illustrates a system for rendering audio content in accordance with an example embodiment.

FIG. 3 illustrates a system 300 for rendering audio content in accordance with an example embodiment of the present invention. As shown, the system 300 comprises a priority level determining unit 301 configured to determine a priority level for an audio object in the audio content; a rendering mode selecting unit 302 configured to select a rendering mode from a plurality of rendering modes for the audio objects based on the determined priority level; and an audio object rendering unit 303 configured to render the audio object in accordance with the selected rendering mode, the rendering mode representing an accuracy of the rendered audio object.

In some example embodiments, the priority level determining unit 301 may comprise a priority metadata extracting unit configured to extract priority metadata as the priority level if the audio object includes priority metadata; and a predefined level assigning unit configured to assign a predefined level to the priority level if the audio object includes no priority metadata.

In some other example embodiments, the rendering mode selecting unit 302 may comprise a computing level assigning unit configured to assign one of a plurality of computing levels to the audio object based on the priority level, each of the computing levels corresponding to one of the plurality of rendering modes, and each of the computing levels requiring an amount of computational resources. The rendering mode selecting unit may be further configured to select the rendering mode for each of the audio objects according to the assigned computing level. Further in example embodiments disclosed herein, the computing level assigning unit may comprise a total computational resources identifying unit configured to identify available total computational resources for the audio content; and a quantity identifying unit configured to identify the quantity of the audio object. The computing level assigning unit may be further configured to assign one of the plurality of computing levels to each of the audio objects based on the priority level, the total computational resources and the quantity of the audio objects if the quantity of the audio object is more than one, or assign one of the plurality of computing levels to the audio object based on the total computational resources if the quantity of the audio object is one. In further example embodiments disclosed herein, the computing level assigning unit may be configured to assign the computing level in sequence from the audio object with the highest priority level to the audio object with the lowest priority level.

In some other example embodiments, the system 300 may further comprises a clustering unit configured to cluster the audio object into one of a plurality of groups based on the priority level of the audio object if the quantity of audio objects is more than one. Further in example embodiments disclosed herein, the rendering mode selecting unit 302 may be further configured to select one of the rendering modes for the audio objects within each of the groups based on the priority level, available total computational resources for the audio content, and the quantity of the audio object.

In some other example embodiments, the rendering mode selecting unit 302 may comprise a predetermined rendering mode assigning unit configured to assign a predetermined rendering mode to each of the audio objects; and a rendering mode updating unit configured to update the rendering mode for each of the audio objects by selecting one from a plurality of rendering modes.

For the sake of clarity, some optional components of the system 300 are not shown in FIG. 3. However, it should be appreciated that the features as described above with reference to FIG. 1 and FIG. 2 are all applicable to the system 300. Moreover, the components of the system 300 may be a hardware module or a software unit module. For example, in some embodiments, the system 300 may be implemented partially or completely with software and/or firmware, for example, implemented as a computer program product embodied in a computer readable medium. Alternatively or additionally, the system 300 may be implemented partially or completely based on hardware, for example, as an integrated circuit (IC), an application-specific integrated circuit (ASIC), a system on chip (SOC), a field programmable gate array (FPGA), and so forth. The scope of the present invention is not limited in this regard.

Figure 4:
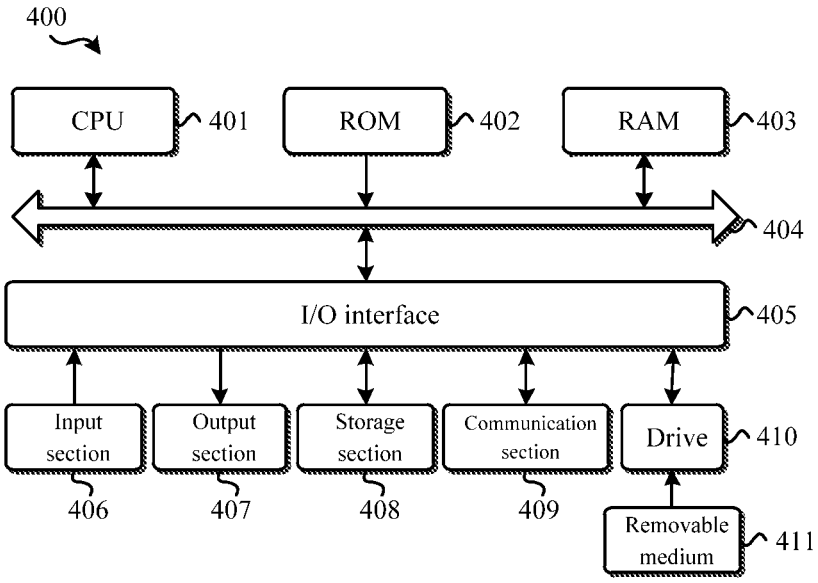
FIG. 4 illustrates a block diagram of an example computer system suitable for the implementing example embodiments disclosed herein.

FIG. 4 shows a block diagram of an example computer system 400 suitable for implementing example embodiments disclosed herein. As shown, the computer system 400 comprises a central processing unit (CPU) 401 which is capable of performing various processes in accordance with a program stored in a read only memory (ROM) 402 or a program loaded from a storage section 408 to a random access memory (RAM) 403. In the RAM 403, data required when the CPU 401 performs the various processes or the like is also stored as required. The CPU 401, the ROM 402 and the RAM 403 are connected to one another via a bus 404. An input/output (I/O) interface 405 is also connected to the bus 404.

The following components are connected to the I/O interface 405: an input section 406 including a keyboard, a mouse, or the like; an output section 407 including a display, such as a cathode ray tube (CRT), a liquid crystal display (LCD), or the like, and a speaker or the like; the storage section 408 including a hard disk or the like; and a communication section 409 including a network interface card such as a LAN card, a modem, or the like. The communication section 409 performs a communication process via the network such as the internet. A drive 410 is also connected to the I/O interface 405 as required. A removable medium 411, such as a magnetic disk, an optical disk, a magneto-optical disk, a semiconductor memory, or the like, is mounted on the drive 410 as required, so that a computer program read therefrom is installed into the storage section 408 as required.

Specifically, in accordance with the example embodiments disclosed herein, the processes described above with reference to FIG. 1 and FIG. 2 may be implemented as computer software programs. For example, example embodiments disclosed herein comprise a computer program product including a computer program tangibly embodied on a machine readable medium, the computer program including program code for performing methods 100 and/or 200. In such embodiments, the computer program may be downloaded and mounted from the network via the communication section 409, and/or installed from the removable medium 411.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server or distributed among one or more remote computers or servers.

Further, while operations are depicted in a particular order, this should not be understood as requiring that such operations be performed in the particular order shown or in a sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other example embodiments set forth herein will come to mind of one skilled in the art to which these embodiments pertain to having the benefit of the teachings presented in the foregoing descriptions and the drawings.

It will be appreciated that the example embodiments disclosed herein are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method of rendering audio content comprising:

determining a priority level for each of a plurality of audio objects in the audio content;

selecting a rendering mode from a plurality of rendering modes for each of the plurality of audio objects based on the respective determined priority level; and rendering each of the plurality of audio objects in accordance with the respective selected rendering mode, the respective selected rendering mode indicating an accuracy of each of the rendered audio objects, wherein each mode of the plurality of rendering modes requires a different amount of computational resources and computing complexity, wherein selecting the rendering mode for each of the plurality of audio objects includes selecting a first rendering mode and a second rendering mode for each of the plurality of audio objects, wherein the first rendering mode has a lower computing complexity than the second rendering mode, and wherein the first rendering mode and the second rendering mode are selected to fully utilize an amount of available computational resources for the plurality of audio objects, and wherein rendering each of the plurality of audio objects includes:

rendering each of the plurality of audio objects a first time using the first rendering mode; and rendering each of the plurality of audio objects a second time using the second rendering mode.

2. The method according to claim 1, wherein determining each priority level comprises:

if an audio object of the plurality of audio objects includes priority metadata, extracting priority metadata as the priority level; or if the audio object includes no priority metadata, assigning a predefined level to the priority level.

3. The method according to claim 1, wherein selecting the rendering mode for each of the plurality of audio objects comprises:

identifying available total computational resources for the audio content;

identifying a quantity of the plurality of audio objects; and selecting the rendering mode for each of the plurality of audio objects based on the respective priority level, the total computational resources and the quantity of the plurality of audio objects.

4. The method according to claim 1, wherein the method further comprises before selecting a rendering mode from a plurality of rendering modes:

clustering the plurality of audio objects into one of a plurality of groups based on the priority level of each of the plurality of audio objects.

5. The method according to claim 4, wherein selecting a rendering mode from a plurality of rendering modes comprises:

selecting one of the rendering modes for a subset of the plurality of audio objects within each of the plurality of groups based on the priority level of each of the plurality of audio objects, available total computational resources for the audio content, and a quantity of the plurality of audio objects.

6. The method according to claim 1, wherein selecting a rendering mode from a plurality of rendering modes comprises:

assigning a predetermined rendering mode to each of the plurality of audio objects; and updating the rendering mode for each of the plurality of audio objects by selecting an updated rendering mode from the plurality of rendering modes.

7. A computer program product for rendering audio content, the computer program product being tangibly stored on a non-transient computer-readable medium and comprising machine executable instructions which, when executed, cause the machine to perform steps of the method according to claim 1.

8. The method according to claim 1, wherein the plurality of audio objects includes a first audio object and a second audio object, wherein the first audio object is rendered according to a first computing level, wherein the second audio object is rendered according to a second computing level, and wherein the first computing level is less complex than the second computing level.

9. The method according to claim 1, wherein the plurality of audio objects includes a first audio object, a second audio object and a third audio object, wherein the first audio object is rendered according to a first computing level, wherein the second audio object is rendered according to a second computing level, wherein the third computing level is rendered according to a third computing level, wherein the first computing level is less complex than the second computing level, and wherein the second computing level is less complex than the third computing level.

10. The method according to claim 1, wherein the plurality of audio objects are rendered such that a less important audio object is rendered in a less complex way.

11. The method according to claim 1, wherein the plurality of audio objects are rendered such that a more important audio object is rendered by allocating more computational resources than a less important audio object.

12. A system for rendering audio content comprising:

a priority level determining unit configured to determine a priority level for each of a plurality of audio objects in the audio content;

a rendering mode selecting unit configured to select a rendering mode from a plurality of rendering modes for each of the plurality of audio objects based on the respective determined priority level; and an audio object rendering unit configured to render each of the plurality of audio objects in accordance with the respective selected rendering mode, the respective selected rendering mode indicating an accuracy of each of the rendered audio objects, wherein each mode of the plurality of rendering modes requires a different amount of computational resources and computing complexity, wherein selecting the rendering mode for each of the plurality of audio objects includes selecting a first rendering mode and a second rendering mode for each of the plurality of audio objects, wherein the first rendering mode has a lower computing complexity than the second rendering mode, and wherein the first rendering mode and the second rendering mode are selected to fully utilize an amount of available computational resources for the plurality of audio objects, and wherein rendering each of the plurality of audio objects includes:

rendering each of the plurality of audio objects a first time using the first rendering mode; and rendering each of the plurality of audio objects a second time using the second rendering mode.

13. The system according to claim 12, wherein the priority level determining unit comprises:

a priority metadata extracting unit configured to extract priority metadata as the priority level of each of the plurality of audio objects if an audio object of the plurality of audio objects includes priority metadata; and a predefined level assigning unit configured to assign a predefined level to the priority level of each of the plurality of audio objects if the audio object includes no priority metadata.

14. The system according to claim 12, wherein the rendering mode selecting unit comprises:

a total computational resources identifying unit configured to identify available total computational resources for the audio content; and a quantity identifying unit configured to identify a quantity of the plurality of audio objects, wherein the rendering mode selecting unit is further configured to select the rendering mode for each of the plurality of audio objects based on the respective priority level, the total computational resources and the quantity of the plurality of audio objects.

15. The system according to claim 12, wherein the system further comprises a clustering unit configured to cluster the plurality of audio objects into one of a plurality of groups based on the priority level of each of the plurality of audio objects.

16. The system according to claim 15, wherein the rendering mode selecting unit is further configured to select one of the rendering modes for a subset of the plurality of audio objects within each of the plurality of groups based on the priority level of each of the plurality of audio objects, available total computational resources for the audio content, and a quantity of the plurality of audio objects.

17. The system according to claim 12, wherein the rendering mode selecting unit comprises:

a predetermined rendering mode assigning unit configured to assign a predetermined rendering mode to each of the plurality of audio objects; and a rendering mode updating unit configured to update the rendering mode for each of the plurality of audio objects by selecting an updated rendering mode from the plurality of rendering modes.

* * * * *